United States Patent [19]

Landen et al.

[11] Patent Number: 4,891,873

[45] Date of Patent: Jan. 9, 1990

[54] DEVICE FOR CRIMPING LARGE FILAMENT GROUPS

[75] Inventors: Peter Landen, Grevenbroich; Dieter Paulini; Wolfram Wagner, both of Dormagen, all of Fed. Rep. of Germany

[73] Assignee: Bayer Aktiengesellschaft, Fed. Rep. of Germany

[21] Appl. No.: 184,111

[22] Filed: Apr. 20, 1988

[30] Foreign Application Priority Data

May 1, 1987 [DE] Fed. Rep. of Germany ..... 3714610

[51] Int. Cl.[4] ..... D02G 1/16

[52] U.S. Cl. ..... 28/255

[58] Field of Search ..... 28/254, 255, 256, 257

[56] References Cited

U.S. PATENT DOCUMENTS

| | | | |
|---|---|---|---|
| 3,778,872 | 12/1973 | Newton | 28/255 |
| 3,952,385 | 4/1976 | Stanley | 28/255 |
| 3,994,052 | 11/1976 | Fernandez | 28/255 |
| 4,103,404 | 8/1978 | Backer et al. | 28/255 |

FOREIGN PATENT DOCUMENTS

| | | | |
|---|---|---|---|
| 0071354 | 2/1983 | European Pat. Off. | 28/254 |
| 2545590 | 4/1977 | Fed. Rep. of Germany | 28/255 |
| 3013811 | 10/1981 | Fed. Rep. of Germany | 28/255 |
| 1161674 | 8/1969 | United Kingdom | 28/255 |
| 2024273 | 1/1980 | United Kingdom | 28/255 |

*Primary Examiner*—Werner H. Schroeder

*Attorney, Agent, or Firm*—Connolly and Hutz

[57] ABSTRACT

A compressing chamber (7) for directed crimping consists of step-shaped bars (8) by way of increasing outwards in length.

6 Claims, 1 Drawing Sheet

DEVICE FOR CRIMPING LARGE FILAMENT GROUPS

BACKGROUND OF THE INVENTION

The invention relates to a device for crimping large filament groups, consisting of a channel for moving filaments in a surrounding gas stream to which a barred cage as a compressing chamber is concentrically attached.

It has been shown to be particularly economical if in the post treatment of the filaments many filament bands are brought together. The crimping provides difficulties in the process, as with an increasing number of filaments the compressing chamber must become larger, in which process there results in the compressing chamber the known meandering deposit, as a result of which predominantly large crimping arcs result with which the desired effect is no longer to be achieved in the thread produced therefrom.

A device for texturing is known in which a conical extension of a nozzle changes over directly into a cylindrical compressing chamber, which consists of round bars arranged at a distance from each other along the exit outlet.

The disadvantage of this device consists in that it is only suitable for crimping with yarn titres up to 3,000 dtex. Post treatment of each individual filament band is however economically too expensive.

SUMMARY OF THE INVENTION

The object of the invention is to find a device which is suitable for carrying out sufficient texturing in the course of subsequent treatment even in filament bands of $10^3$–$10^8$ filaments, in particular of $10^4$–$10^6$ filaments, wherein a dampness content of 2–60% by weight must still be processable.

The object is solved according to the invention in that in the region between the outlet rim of the channel and the rod lying further out at least some short obstacles, narrow in a tangential direction, are arranged.

For example, a filament group previously loosened up and strongly braked as a result of the divergence of the channel, separates through the obstacles, which are preferably arranged on lines parallel to the cage and/or outlet rim, into several supply streams. The central filaments, arriving at the centre and rolling from side to side because of the braking effect, collide in the centre of the thread stopper and are thereby crimped. The outer filaments, after leaving the nozzle, lie immediately against the obstacle conditioned by the lateral gas, in which process as a result of the strong twisting (less than 180° C.), intensive shaping takes place. While the filaments present in the ring region lying in between seek the path to the exterior bars between or over the obstacles and are there crimped by penetrating into the gaps.

In contrast to the meandering depositing of the crimped filaments, the yarn stopper is here pushed on axially in the compressing chamber through the central air division. The obstacles of 4–40 mm, in particular 5–15 mm in height are therein always released again, in which process the slipping is moderated by a possible inclination (2°–15°) of the normally round bars (1.5–6 mm).

The directing of gas outwards can be still further improved by a face wall rising in steps or gradually from the outlet rim to the exterior bars, wherein it may be advantageous to arrange several barriers in a ring shape and possibly displaced relative to each other for the generating of flow shadows. By means of these two measures (face wall design and staggered barriers) it is possible to intensify the crimping and to smooth or adjust it in a defined way.

BRIEF DESCRIPTION OF THE DRAWING

Examples of the invention are represented in the diagrams and will be more closely described in the following. In the diagrams.

DETAILED DESCRIPTION OF THE INVENTION

Figure 1:
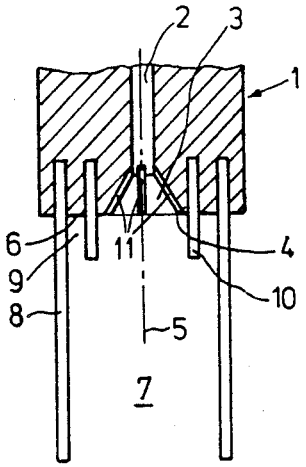
FIG. 1 shows a longitudinal section through nozzle and compressing chamber.
Figure 2:
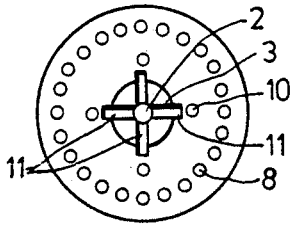
FIG. 2 shows a view of the open side of the compressing chamber.

In FIGS. 1 and 2 the nozzle is represented, possessing in its interior an elongated hollow space 2, which goes over into a diverging channel 3.

At the outlet rim 4 a face wall 6 connects perpendicularly to the axis 5 with the compressing chamber 7, in which bars 8, round outside and cold drawn, and in the intervening region 9 obstacles in the form of round short elements 10, are inserted. Further, groove-like depressions 11 are provided at the outlet rim.

Figure 3:
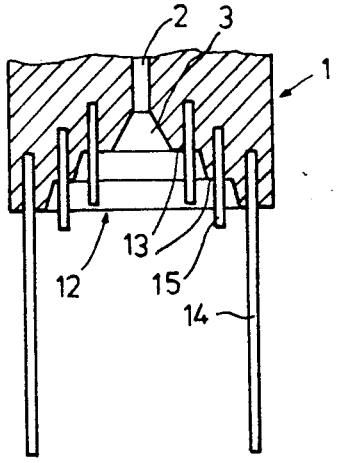
FIG. 3 shows a longitudinal section through nozzle with step wise face wall of the compressing chamber.
Figure 4:
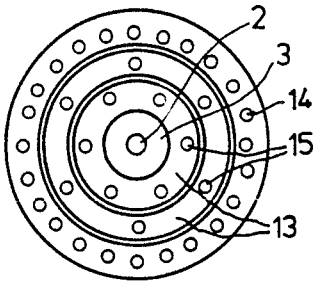
FIG. 4 shows a view of the open side of the compressing chamber.

In FIGS. 3 and 4 a nozzle 1 is drawn, in which after a central cylindrical hollow space 2 with post diverging channel 3 the face wall 12 is designed in steps 13 projecting outwards, which accepts a cage with long round bars 14 outside and two rows of short elements 15 inside parallel to the axis 5.

Figure 5:
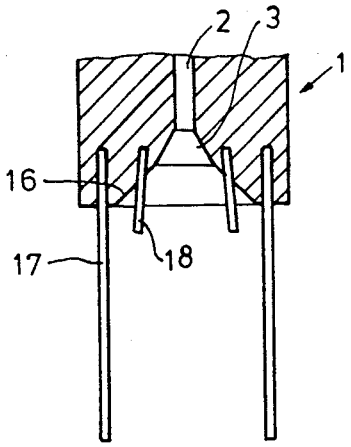
FIG. 5 shows a longitudinal section through nozzle with slanting face wall of the compressing chamber.

In FIG. 5 a longitudinal section is represented, in which after the hollow space 2 and the diverging channel 3 a conical expansion 16 follows. Bars 17 extend in an outward direction, elements 18 are inserted in parallel to the axis 5. Elements 18 also extend outwardly but at an angle to axis 5.

The elongated hollow space or channel 2 has a longitudinal axis 5 and the rods 18 of the second cage are outwardly angled 2°–15° relative to that axis. Also, the rods 17 of the first cage are 2–25 mm longer than the rods 18 of the second cage.

We claim:

1. A device for crimping large filament groups comprising a channel for moving filaments in a surrounding gas stream, a face wall through which the channel opens, and a compression chamber secured to the face wall comprising a first cage and at least a second cage, each cage including a plurality of spaced apart rods extending from the face wall and concentrically arranged around the channel opening therein, the second cage having shorter rods than the first cage and being located between the first cage and the channel opening in the face wall.

2. A device as in claim 1 wherein the face wall is step-shaped.

3. A device as in claim 1 wherein the channel has a diverging portion that opens at the face wall.

4. A device as in claim 1 wherein the rods of the first cage are 2–25 mm longer than the rods of the second cage.

5. A device as in claim 1 wherein the channel has a longitudinal axis and the rods of the second cage are outwardly angled 2°–15° relative to that axis.

6. A device as in claim 1 wherein the face wall includes groove-like depressions.

* * * * *